US010745639B2

(12) United States Patent
Jakupca et al.

(10) Patent No.: US 10,745,639 B2
(45) Date of Patent: Aug. 18, 2020

(54) POLYMERIC POLY-PHOSPHORUS LUBRICANT ADDITIVES FOR METAL WORKING

(71) Applicant: Dover Chemical Corporation, Dover, OH (US)

(72) Inventors: Mick Jakupca, Canton, OH (US); Don Stevenson, Dover, OH (US); John Nussbaumer, Bolivar, OH (US); Jacob Weingart, Canton, OH (US)

(73) Assignee: Dover Chemical Corporation, Dover, OH (US)

( * ) Notice: Subject to any disclaimer, the term of this patent is extended or adjusted under 35 U.S.C. 154(b) by 67 days.

(21) Appl. No.: 15/900,148

(22) Filed: Feb. 20, 2018

(65) Prior Publication Data

US 2018/0237719 A1 Aug. 23, 2018

Related U.S. Application Data

(60) Provisional application No. 62/461,084, filed on Feb. 20, 2017, provisional application No. 62/619,351, filed on Jan. 19, 2018.

(51) Int. Cl.
*C10M 153/00* (2006.01)
*C10M 153/04* (2006.01)
(Continued)

(52) U.S. Cl.
CPC ..... *C10M 153/04* (2013.01); *C10M 137/105* (2013.01); *C10M 2223/04* (2013.01);
(Continued)

(58) Field of Classification Search
CPC ..... C10M 153/04; C10M 2225/00; C10M 2223/04; C10M 2223/0405;
(Continued)

(56) References Cited

U.S. PATENT DOCUMENTS 6,489,271 B1 12/2002 Richardson
2010/0137174 A1* 6/2010 Maeda ..... C10M 133/44 508/279

(Continued)

FOREIGN PATENT DOCUMENTS

WO 2016077134 A1 5/2016
WO WO-2016077134 A1 * 5/2016 ..... C10M 153/04

OTHER PUBLICATIONS

XP-002780520 (Synthesis and hydrolytic stability of polyoxyethylene-H-phosphonates) & JPS60209077 (Year: 1985).*

(Continued)

*Primary Examiner* — Taiwo Oladapo
(74) *Attorney, Agent, or Firm* — Black, McCuskey, Souers & Arbaugh LPA

(57) ABSTRACT

A composition having a compound having the structure:

wherein each R is an independently selected alkylphenol-free moiety that is a $C_{1-20}$ alkyl, $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety; wherein each Y is an independently selected alkylphenol-free moiety that is a $C_{2-40}$ alkylene, $C_{7-40}$ cycloalkylene, or $C_{3-40}$ alkyl lactone moiety; wherein m is an integer ranging from 1 to 100; and wherein x is an integer ranging from 1 to 1000.

30 Claims, 3 Drawing Sheets

(51) Int. Cl.

| | |
|---|---|
| ***C10M 137/10*** | (2006.01) |
| *C10N 20/04* | (2006.01) |
| *C10N 30/06* | (2006.01) |
| *C10N 40/20* | (2006.01) |

(52) U.S. Cl.
CPC ..... *C10M 2223/0405* (2013.01); *C10M 2223/047* (2013.01); *C10M 2223/049* (2013.01); *C10M 2223/0495* (2013.01); *C10M 2225/00* (2013.01); *C10M 2225/003* (2013.01); *C10N 2020/04* (2013.01); *C10N 2030/06* (2013.01); *C10N 2040/20* (2013.01)

(58) Field of Classification Search
CPC ..... C10M 2223/047; C10M 2223/049; C10M 2223/0495; C10M 2225/003; C10M 137/105; C10N 2220/021; C10N 2240/40; C10N 2230/06
See application file for complete search history.

(56) References Cited

U.S. PATENT DOCUMENTS

| | | | | |
|---|---|---|---|---|
| 2011/0306530 | A1* | 12/2011 | Manabe | C10M 137/04 508/287 |
| 2013/0079264 | A1 | 3/2013 | Tipton | |
| 2014/0329943 | A1* | 11/2014 | Jakupca | C08K 5/52 524/128 |
| 2018/0282654 | A1* | 10/2018 | Abraham | C10M 153/04 |

OTHER PUBLICATIONS

Database CA [Online] Chemical Abstracts Services, Columbus, Ohio, US, Noda, Ippei, et al.: "Lubricants for synthetic fibers", XP002780518 retrieved from STN Database accession No. 1986:150749—abstract; 2 pages.

Database CA [Online] Chemical Abstracts Services, Columbus, Ohio, US, Nobis, Markus N., et al.: "Poly(arylazophosphonate)s new arylazophosphonate—containing monomers for synthesis of laser-structurable polymers", XP002780519 retrieved from STN Database accession No. 2001:735270—abstract; and Macromolecular Chemistry and Physics, 202 (13), 2769-2775 Coden: Mchpes; ISSN: 1022-1352, 2001, DOI: 10.1002/1521-3935(Sep. 1, 2001) 202:13<2769: 2 pages.

Database CA [Online] Chemical Abstracts Services, Columbus, Ohio, US, Gitsov, Ivan et al.: "Synthesis and hydrolytic stability of ply(oxyethylene-H-phosphonate)s", XP002780520 retrieved from STN Database accession No. 2008:724200 abstract; and Journal of Polymer Science, Part A: Polymer Chemistry, 46(12), 4130-4139 CODEN: JPACES; ISSN: 0887-624X, 2008, DOI: 10.1002/POLA. 22759 10.1002/POLA.22759; 2 pages.

Database CA [Online] Chemical Abstracts Services, Columbus, Ohio, US, Keglevich, Gyoergy, et al.: "Microwave-assisted alcholysis of dialkyl phosphites by ethylene glycol and ethanolamine", XP002780521 retrieved from STN Database accession No. 2014:1930090 abstract; and Pure and Applied Chemistry, 86(11), 1723-1728 CODEN: PACHAS; ISSN: 0033-4545, 2014, DOI: 10.1515/PAC-2014-0601 10.1515/PAC-2014-0601; 1 page.

Database CA [Online] Chemical Abstracts Services, Columbus, Ohio, US, Han, Hengwen, et al.: "Biphosphite amine salt and its preparing method, application thereof and lubricating oil composition", XP002780522 retrieved from STN Database accession No. 2014:2007198 abstract; 2 pages.

Database CA [Online] Chemical Abstracts Services, Columbus, Ohio, US, Tominaga, Eiji, et al: "Lubricating oil compositions for sliding guideway", XP002780523 retrieved from STN Database accession No. 1996:641045 abstract & JP H08 209175 A (Nippon Oil Co Ltd) Aug. 13, 1996 (Aug. 13, 1996); 1 page.

International Search Report for corresponding PCT application; 14 pages.

www.mdpi.com/journal/lubricants, David W. Johnson, et al.: "Phosphate Esters, Thiophosphates Esters and Metal Thiophosphates as Lubricant Additives" Published Dec. 18, 2013, 132-148, ISSN 2075-4442, DOI: 10.3390/lubricants 1040132: 17 pages.

Ciba IRGALUBE TPPT Extreme Pressure/antiwear additive, Ciba Speciality Chemicas, Inc, Reference AD7, CH-4002 Basle, Publ. No. 28979/96/e, Edited in Switzerland; 8 pages.

Extreme Pressure/Antiwear Additive Ciba IRGALUBE 211cd, Alkylated triphenyl phosphorothionate; 1 page.

Dover Chemical Corporation, Doverlube SP-44, Light Colored Sulphur-Phosphorus Additive; 1 page.

* cited by examiner

POLYMERIC POLY-PHOSPHORUS LUBRICANT ADDITIVES FOR METAL WORKING

CROSS REFERENCE TO RELATED APPLICATIONS

This nonprovisional patent application claims priority to the following-two U.S. patent applications:

i) U.S. provisional patent application 62/461,084 titled, "Alkylphenol-Free Polymeric Thiophosphates for Metalworking Fluids," and ii) ii) U.S. provisional patent application 62/619,351 titled, "Alkylphenol-Free Polymeric Phosphites for Metalworking Fluids."

The subject matter of both provisional patent applications is hereby incorporated by reference.

BACKGROUND OF THE INVENTION

Metalworking fluids are well known, and there is a need for improved metalworking fluids.

BRIEF SUMMARY OF THE INVENTION

A composition having a compound having the structure:

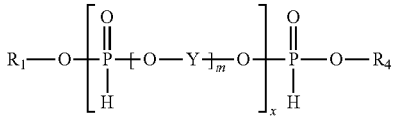

wherein each R is an independently selected alkylphenol-free moiety that is a $C_{1-20}$ alkyl, $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety; wherein each Y is an independently selected alkylphenol-free moiety that is a $C_{2-40}$ alkylene, $C_{7-40}$ cycloalkylene, or $C_{3-40}$ alkyl lactone moiety; wherein m is an integer ranging from 1 to 100; and wherein x is an integer ranging from 1 to 1000.

A composition having a compound having the structure:

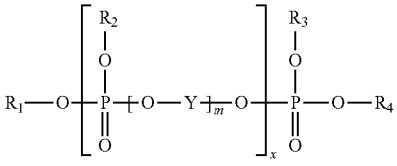

wherein each R is an independently selected alkylphenol-free moiety that is a $C_{1-20}$ alkyl, $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety; wherein each Y is an independently selected alkylphenol-free moiety that is a $C_{2-40}$ alkylene, $C_{7-40}$ cycloalkylene, or $C_{3-40}$ alkyl lactone moiety; wherein m is an integer ranging from 1 to 100; and wherein x is an integer ranging from 1 to 1000.

A composition having a compound having the structure:

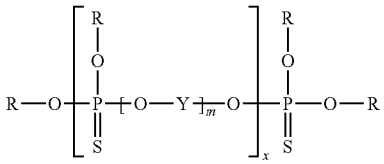

wherein each R is an independently selected alkylphenol-free moiety that is a $C_{1-20}$ alkyl, $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety; wherein each Y is an independently selected alkylphenol-free moiety that is a $C_{2-40}$ alkylene, $C_{7-40}$ cycloalkylene, or $C_{3-40}$ alkyl lactone moiety; wherein m is an integer ranging from 1 to 100; and wherein x is an integer ranging from 1 to 1000.

A composition having a compound having the structure:

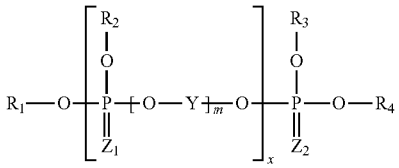

wherein each R is an independently selected alkylphenol-free moiety that is a $C_{1-20}$ alkyl, $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety; wherein each Y is an independently selected alkylphenol-free moiety that is a $C_{2-40}$ alkylene, $C_{7-40}$ cycloalkylene, or $C_{3-40}$ alkyl lactone moiety; wherein each Z is independently selected from the group consisting of S and O; wherein m is an integer ranging from 1 to 100; and wherein x is an integer ranging from 1 to 1000.

A composition having a compound having the structure:

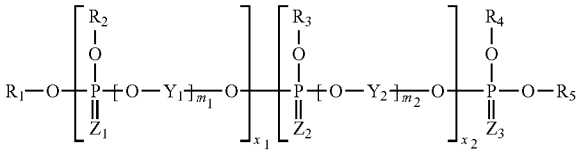

wherein each R is an independently selected alkylphenol-free moiety that is a $C_{1-20}$ alkyl, $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety; wherein each Y is an independently selected alkylphenol-free moiety that is a $C_{2-40}$ alkylene, $C_{7-40}$ cycloalkylene, or $C_{3-40}$ alkyl lactone moiety; wherein each Z is independently selected from the group consisting of S and O; wherein m is an integer ranging from 1 to 100; and wherein x is an integer ranging from 1 to 1000.

A method having the step of using the following compound as a metalworking fluid additive:

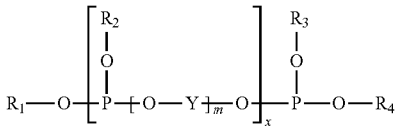

wherein each R is an independently selected moiety that is a $C_{1-20}$ alkyl, $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety; wherein each Y is an independently selected alkylphenol-free moiety that is a $C_2$-40 alkylene, $C_{7-40}$ cycloalkylene, or $C_{3-40}$ alkyl lactone moiety; wherein m is an integer ranging from 1 to 100; and wherein x is an integer ranging from 1 to 1000.

DETAILED DESCRIPTION OF THE INVENTION

Figure 1:
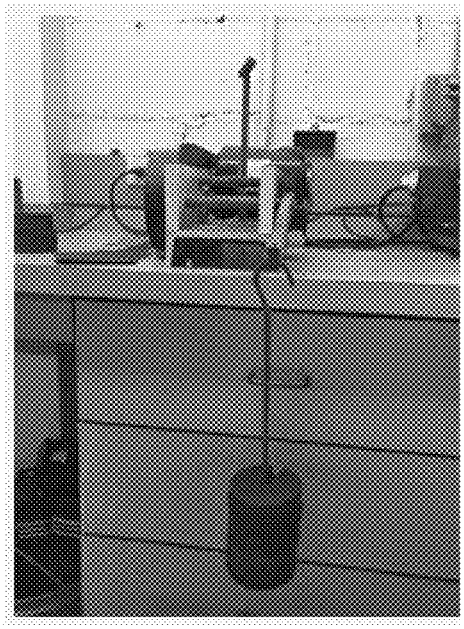
FIG. 1 is a picture of a Timken testing apparatus.

Embodiments are directed to compounds that are useful as metalworking-fluid additives.

An embodiment is directed to polyhydrogen-phosphite compounds having the general structure:

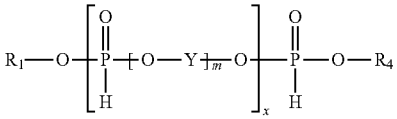

wherein each R is an independently selected alkylphenol-free moiety that is a $C_{1-20}$ alkyl, $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety;
wherein each Y is an independently selected alkylphenol-free moiety that is a $C_{2-40}$ alkylene, $C_{7-40}$ cycloalkylene, or $C_{3-40}$ alkyl lactone moiety;
wherein m is an integer ranging from 1 to 100; and wherein x is an integer ranging from 1 to 1000.

In some polyhydrogen-phosphite embodiments, each Y is an ethylene, propylene, or caprylactone moiety.

In some polyhydrogen-phosphite embodiments, the compound has a weight ranging from 1000 to 30000 Daltons. In some polyhydrogen-phosphite embodiments, the compound has a weight ranging from 400 to 30000 Daltons. In some polyhydrogen-phosphite embodiments, the compound has a weight ranging from 500 to 30000 Daltons.

An embodiment is directed to phosphate compounds having the general structure:

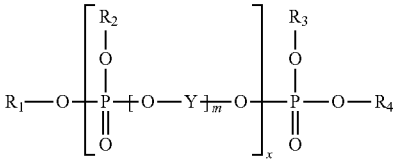

wherein each R is an independently selected alkylphenol-free moiety that is a $C_{1-20}$ alkyl, $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety;
wherein each Y is an independently selected alkylphenol-free moiety that is a $C_{2-40}$ alkylene, $C_{7-40}$ cycloalkylene, or $C_{3-40}$ alkyl lactone moiety;
wherein m is an integer ranging from 1 to 100; and
wherein x is an integer ranging from 1 to 1000.

In some phosphate embodiments, each Y is an ethylene, propylene, or caprylactone moiety.

In some phosphate embodiments, the compound has a weight ranging from 1000 to 30000 Daltons. In some phosphate embodiments, the compound has a weight ranging from 400 to 30000 Daltons. In some phosphate embodiments, the compound has a weight ranging from 500 to 30000 Daltons.

An embodiment is directed to thiophosphate compounds having the general structure:

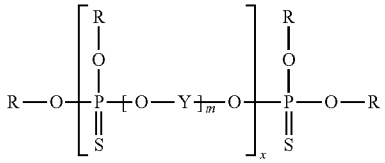

wherein each R is an independently selected alkylphenol-free moiety that is a $C_{1-20}$ alkyl, $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety;
wherein each Y is an independently selected alkylphenol-free moiety that is a $C_{2-40}$ alkylene, $C_{7-40}$ cycloalkylene, or $C_{3-40}$ alkyl lactone moiety;
wherein m is an integer ranging from 1 to 100; and
wherein x is an integer ranging from 1 to 1000.

In some thiophosphate embodiments, each Y is an ethylene, propylene, or caprylactone moiety.

In some thiophosphate embodiments, the compound has a weight ranging from 1000 to 30000 Daltons. In some thiophosphate embodiments, the compound has a weight ranging from 400 to 30000 Daltons. In some thiophosphate embodiments, the compound has a weight ranging from 500 to 30000 Daltons.

An embodiment is directed to phosphorus-containing compounds having the general structure:

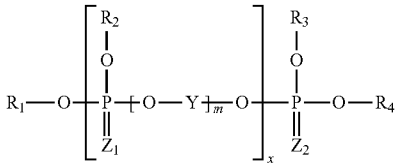

wherein each R is an independently selected alkylphenol-free moiety that is a $C_{1-20}$ alkyl, $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety;
wherein each Y is an independently selected alkylphenol-free moiety that is a $C_{2-40}$ alkylene, $C_{7-40}$ cycloalkylene, or $C_{3-40}$ alkyl lactone moiety;
wherein each Z is independently selected from the group consisting of S and O;

wherein m is an integer ranging from 1 to 100; and
wherein x is an integer ranging from 1 to 1000.

In some phosphorus-containing-compound embodiments, each Y is an ethylene, propylene, or caprylactone moiety.

In some phosphorus-containing-compound embodiments, the compound has a weight ranging from 1000 to 30000 Daltons. In some phosphorus-containing embodiments, the compound has a weight ranging from 400 to 30000 Daltons. In some phosphorus-containing embodiments, the compound has a weight ranging from 500 to 30000 Daltons.

An embodiment is directed to phosphorus-containing copolymer compounds having the general structure:

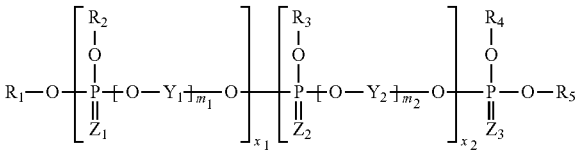

wherein each R is an independently selected alkylphenol-free moiety that is a $C_{1-20}$ alkyl, $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety;
wherein each Y is an independently selected alkylphenol-free moiety that is a $C_{2-40}$ alkylene, $C_{7-40}$ cycloalkylene, or $C_{3-40}$ alkyl lactone moiety;
wherein each Z is independently selected from the group consisting of S and O;
wherein m is an integer ranging from 1 to 100; and
wherein x is an integer ranging from 1 to 1000.

In some phosphorus-containing copolymer compound embodiments, each Y is an ethylene, propylene, or caprylactone moiety.

In some phosphorus-containing copolymer compound embodiments, the compound has a weight ranging from 1000 to 30000 Daltons. In some phosphorus-containing copolymer compound embodiments, the compound has a weight ranging from 400 to 30000 Daltons. In some phosphorus-containing copolymer compound embodiments, the compound has a weight ranging from 500 to 30000 Daltons.

An embodiment is directed to phosphite compounds having the general structure:

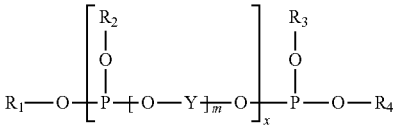

wherein each R is an independently selected moiety that is a $C_{1-20}$ alkyl, $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety;
wherein each Y is an independently selected alkylphenol-free moiety that is a $C_{2-40}$ alkylene, $C_{7-40}$ cycloalkylene, or $C_{3-40}$ alkyl lactone moiety;
wherein m is an integer ranging from 1 to 100; and
wherein x is an integer ranging from 1 to 1000.

In some phosphite embodiments, each Y is an ethylene, propylene, or caprylactone moiety.

In some phosphorus-containing copolymer compound embodiments, the compound has a weight ranging from 1000 to 30000 Daltons. In some phosphorus-containing copolymer compound embodiments, the compound has a weight ranging from 400 to 30000 Daltons. In some phosphorus-containing copolymer compound embodiments, the compound has a weight ranging from 500 to 30000 Daltons.

Methods for manufacturing phosphite compounds, polyhydrogen phosphite compounds, phosphate compounds, thiophosphate compounds, and thiophosphite-phosphate copolymer compounds can be determined by persons of ordinary skill in the art without having to exercise undue experimentation. Non-limiting examples of manufacturing methods can be found in the below Examples.

Metalworking additives are well known, and any of the above compounds, either alone or in any combination, can be used as additives for metalworking fluids. Any of the above compounds, either alone or in any combination, can be used as additives for metalworking fluids in useful amounts that can be determined by persons of ordinary skill in the art. As a non-limiting example, useful amounts of the above compounds, either alone or in any combination, range from 5 to 10% by weight of the metalworking fluid. In an additional non-limiting example, useful amounts of the above compounds, either alone or in any combination, range from 0.5 to 20% by weight of the metalworking fluid.

In any of the above sulfur-containing compounds, the amount of sulfur within the compound can range from 50 to 100 mole percent relative to the amount of phosphorus within the compound; stated differently, in any of the above sulfur-containing compounds, anywhere from half to all of the phorphorus atoms are bonded to a sulfur atom. In another embodiment, the amount of sulfur within the compound can range from 90 to 100 mole percent relative to the amount of phosphorus within the compound. In another embodiment, the amount of sulfur within the compound is 100 mole percent relative to the amount of phosphorus within the compound.

Examples I

TNPP-T (Trisnonylphenyl Thiophosphate)

To a three-neck 250 mL flask equipped with a mechanical stirrer and purged with nitrogen was added 75.83 grams of triisnonylphenol phosphite (0.110 mol), with a total nonylphenol content ranging from 0.05% to 0.5% with 0.1% being the target and 0.39 grams of 2,5-dimercapto-1,3,4-thiadiazole (0.0026 mol). The mixture was mixed well and heat was applied to a reaction temperature of 240° F. 3.37 grams of elemental sulfur (0.130 mol) was then added at this temperature. After one hour, the reaction temperature is increased to 280° F. and held for 16-24 hours. This reaction takes place under a nitrogen blanket. The resulting thiophosphate had the following analysis:

| | |
|---|---|
| % Phosphorous | 4.5 |
| % Sulfur | 4.2 |
| Density 20 C | 1.01 |
| Color, APHA | 50 |
| % Nonylphenol | <0.20 |

LGP-11-T (Alkylphenol Free Polymeric Polyphosphite), U.S. Pat. No. 8,563,637B

To a three-neck 250 mL flask equipped with a mechanical stirrer and purged with nitrogen was added 75.83 grams of a alkylphenol-free liquid polymeric phosphite (Example #2 from U.S. Pat. No. 8,563,637), with a molecular weight of about 9100 and 0.39 grams of 2,5-dimercapto-1,3,4-thiadiazole (0.0026 mol). The mixture was mixed well and heat was applied to a reaction temperature of 240° F. Then 3.51 grams of elemental sulfur (0.109 mol) was added. After one hour, the reaction temperature is increased to 280° F. and held for 16-24 hours. This reaction takes place under a nitrogen blanket. The resulting alkyl phenol free polymeric thiophosphate had the following analysis:

| | |
|---|---|
| % Phosphorous | 4.7 |
| % Sulfur | 4.4 |
| Density 20 C | |
| Color, APHA | 60 |
| % Nonylphenol | 0 |

LGP-12-T (Alkylphenol Free Cycloaliphatic Poly and Copoly Phosphites) U.S. Pat. No. 8,981,042B2

To a three-neck 250 mL flask equipped with a mechanical stirrer and purged with nitrogen was added 75.83 grams of cycloaliphatic polyphosphite (Example 2 from U.S. Pat. No. 8,981,042) with a molecular weight range of about 14,000 and 0.39 grams of 2,5-dimercapto-1,3,4-thiadiazole (0.0026 mol). The mixture was mixed well and heat was applied to a reaction temperature of 240° F. 5.52 grams of elemental sulfur (0.172 mol) was then added. After one hour, the reaction temperature is increased to 280° F. and held for 16-24 hours. This reaction takes place under a nitrogen blanket. The resulting analysis of the phenol free cycloaliphatic alkylated poly thiophosphate was:

| | |
|---|---|
| % Phosphorous | 7.2 |
| % Sulfur | 6.75 |
| Color, APHA | 50 |
| % Nonylphenol | 0 |

LGP(DPG)-11-T, U.S. Pat. No. 8,563,637B

To a three-neck 250 mL flask equipped with a mechanical stirrer and purged with nitrogen was added 75.83 grams of a alkylphenol-free liquid polymeric phosphite (Example #3 from U.S. Pat. No. 8,563,637), with a molecular weight of about 1200 and 0.39 grams of 2,5-dimercapto-1,3,4-thiadiazole (0.0026 mol). The mixture was mixed well and heat was applied to a reaction temperature of 240° F. Then 6.29 grams of elemental sulfur (0.196 mol) was added. After one hour, the reaction temperature is increased to 280° F. and held for 16-24 hours. This reaction takes place under a nitrogen blanket. The resulting alkyl phenol free polymeric thiophosphate had the following analysis:

| | |
|---|---|
| % Phosphorous | 7.8 |
| % Sulfur | 7.6 |
| Color, APHA | 60 |
| % Nonylphenol | 0 |

DP-6T (Triisodecyl Phosphite) Doverphos 6

To a three-neck 250 mL flask equipped with a mechanical stirrer and purged with nitrogen was added 75.83 grams of a Triisodecyl phosphite, with a molecular weight of about 500 and 0.39 grams of 2,5-dimercapto-1,3,4-thiadiazole (0.0026 mol). The mixture was mixed well and heat was applied to a reaction temperature of 240° F. Then 4.87 of elemental sulfur (0.152 mol) was added. After one hour, the reaction temperature is increased to 280° F. and held for 16-24 hours. This reaction takes place under a nitrogen blanket. The resulting alkyl phenol free thiophosphate had the following analysis:

| | |
|---|---|
| % Phosphorous | 6.2 |
| % Sulfur | 6.0 |
| Color, APHA | 60 |
| % Nonylphenol | 0 |

Testing Methodology

Four Ball Wear: This test is used for evaluating friction-reducing and anti-wear fluids. Testing involves 3 stationary steel balls secured in a steel cup and a $4^{th}$ steel ball lowered to make contact with the 3 stationary balls. The fluid to be tested is poured into the cup. The $4^{th}$ ball is the only ball that spins. Typical rpm for the ball is 1200 rpm. The single ball spins in contact with the 3 stationary balls at a constant load of 40 kg. Typical run time is 1 hour. The wear on the lower 3 balls is measured and reported in mm. The fluid to produce the smallest wear scars has the best performance.

| Parameter | Setting |
|---|---|
| Load (kg) | 40 |
| Temperature | Ambient |
| Time (min) | 60 |
| Dilution Rate | 5% |
| Speed (rpm) | 1,200 |

Wear Scar (mm)

| Ball | Example 1 | Example 2 | Example 3 | Example 4 | Example 5 |
|---|---|---|---|---|---|
| 1 | 0.91 | 0.39 | 0.52 | 0.52 | 0.57 |
| 2 | 0.91 | 0.39 | 0.52 | 0.52 | 0.55 |
| 3 | 0.86 | 0.39 | 0.52 | 0.52 | 0.55 |
| Avg. mm | 0.89 | 0.39 | 0.52 | 0.52 | 0.55 |

Test results clearly show that the alkylphenol free polymeric polyphosphites give excellent results, better than the commercial trisnonylphenyl thiophosphate with excellent color. And there are no alkylphenols in the final products.

Timken Testing: Timken testing was carried out by adding weight to a lever applying pressure to a block that is in contact with a wheel. The bottom portion of the wheel is submersed in the fluid to be tested. As the wheel spins, the lubricant is carried to the interface of the block and wheel. A one pound weight is added to the lever every minute until a maximum of 13 pounds has been added. The wear scar on the block is measured and reported in millimeters. See FIG. 1.

Wear Scar (mm)

| Example 1 | Example 2 | Example 3 | Example 4 | Example 5 |
|---|---|---|---|---|
| 2.34 | 2.08 | 2.08 | 2.24 | 2.60 |

Test results clearly show that the alkylphenol free polymeric polyphosphites give excellent results, better than the commercial trisnonylphenyl thiophosphate with excellent color. And there are no alkylphenols in the final products.

Examples II

The following formulae were prepared for various machine testing:

Oil Based Formulae

| Additive | Functionality | Conc. % By Weight | Methyl Ester Added |
|---|---|---|---|
| Paroil 152 | Chlorinated Paraffin | 5 | 7 |
| Mayfree 133 | Phosphate Amide | 2.6 | 4.4 |
| Doverphos 253 | Di-oleyl Hydrogen Phosphite | 2.6 | 7 |
| Doverphos 53 | Tri-lauryl Phosphite | 2.6 | 7 |
| Doverphos 50 | Phosphite | 2.6 | 7 |
| Complex Ester 5% | Ester | 5 | 0 |
| Complex Ester 10% | Ester | 10 | 0 |
| Complex Ester 25% | Ester | 25 | 0 |
| Alkylphenol Free Polymeric Phosphite A | Phosphite | 2.6 | 7 |
| Alkylphenol Free Polymeric Phosphite B | Phosphite | 2.6 | 7 |
| Base 10SE | Sulfurized Ester | 5 | 2 |
| Alkylphenol Free Polymeric Thiophosphate A | Phos & Sulfur | 5 | 7 |
| Alkylphenol Free Polymeric Thiophosphate B | Phos & Sulfur | 5 | 7 |
| ZDDP | Phos, Sulfur & Zinc | 2.6 | 7 |

Water Based Formulae

The water based formulae were prepared using a commercial semi-synthetic. The additive was added to either the Super Concentrate (SC) prior to dilution of the semi-synthetic with water, or to the concentrate after 50% dilution of the semi-synthetic with water. After the 50% dilution with water, all testing was conducted with the semi-synthetic diluted in water at 5%.

| Additive | % Added to S.C. | % Added to Concentrate | Final Conc. % |
|---|---|---|---|
| Paroil 152 | 5 | 0 | 5 |
| Mayfree 133 | 0 | 2.6 | 5 |
| Doverphos 253 | 0 | 2.6 | 5 |
| Doverphos 53 | 0 | 2.6 | 5 |
| Dovephos 50 | 0 | 2.6 | 5 |
| Complex Ester 5% | 0 | 5 | 5 |
| Alkylphenol Free Polymeric Phosphite A | 0 | 2.6 | 5 |
| Alkylphenol Free Polymeric Phosphite B | 0 | 2.6 | 5 |

Testing Methodology

Oil Based Testing:

Four Ball Wear: This test is used for evaluating friction-reducing and anti-wear fluids. Testing involves 3 stationary steel balls secured in a steel cup and a $4^{th}$ steel ball lowered to make contact with the 3 stationary balls. The fluid to be tested is poured into the cup. The $4^{th}$ ball is the only ball that spins. Typical rpm for the ball is 1200 rpm. The single ball spins in contact with the 3 stationary balls at a constant load of 40 kg. Typical run time is 1 hour. The wear on the lower 3 balls is measured and reported in mm. The fluid to produce the smallest wear scars has the best performance.

| Parameter | Setting |
|---|---|
| Load (kg) | 40 |
| Temperature | Ambient |
| Time (min) | 60 |
| Speed (rpm) | 1,200 |

Wear Scar (mm)

| Additive | Average Wear, mm |
|---|---|
| Paroil 152, Std. | 0.99 |
| Doverphos 53 | 0.41 |
| ZDDP | 0.45 |
| Base 10SE | 0.52 |
| Doverphos 253 | 0.54 |
| Mayfree 133 | 0.61 |
| Alkylphenol Free Polymeric Phosphite A | 0.36 |
| Alkylphenol Free Polymeric Phosphite B | 0.49 |
| Doverphos 50 | 0.46 |
| Alkylphenol Free Polymeric Thiophosphate A | 0.36 |
| Alkylphenol Free Polymeric Thiophosphate B | 0.39 |
| Polymeric Ester-5% | 0.66 |
| Polymeric Ester-10% | 0.65 |
| Polymeric Ester-25% | 0.53 |

Vertical Drawbead: Vertical Drawbead is a machine used to determine a fluids ability to form a piece of metal. Vertical Drawbead works by applying pressure to a coated metal strip. The formulae to be tested is applied to a 24 inch metal strip which is raised between two dye. The dyes apply 500 psi of pressure to the bottom of the strip. The coated strip is pulled between the two dyes. The amount of force needed to pull the strip between the dyes, is plotted by an X-Y plotter and the force is calculated from this curve. In all cases, higher percent efficiency refers to the performance of the fluid being better.

In this test, all formulae were evaluated on 1018 Steel and 316 Stainless Steel.

316 Stainless Steel

| Additive | % Efficiency |
|---|---|
| Paroil 152, Std. | 100.0 |
| Doverphos 53 | 95.1 |
| ZDDP | 103.8 |
| Base 10SE | 81.0 |
| Doverphos 253 | 77.3 |
| Mayfree 133 | 102.2 |
| Alkylphenol Free Polymeric Phosphite A | 70.3 |
| Alkylphenol Free Polymeric Phosphite B | 46.4 |
| Doverphos 50 | 103.8 |
| Alkylphenol Free Polymeric Thiophosphate A | 114.2 |
| Alkylphenol Free Polymeric Thiophosphate B | 119.0 |
| Polymeric Ester-5% | 112.5 |
| Polymeric Ester-10% | 116.8 |
| Polymeric Ester-25% | 147.6 |

1018 Steel

| Additive | % Efficiency |
|---|---|
| Paroil 152, Std. | 100.0 |
| Doverphos 53 | 109.4 |
| ZDDP | 103.8 |
| Base 10SE | 103.3 |
| Doverphos 253 | 105.4 |
| Mayfree 133 | 97.1 |
| Alkylphenol Free Polymeric Phosphite A | 103.5 |

-continued

| Additive | % Efficiency |
|---|---|
| Alkylphenol Free Polymeric Phosphite B | 102.3 |
| Doverphos 50 | 111.6 |
| Alkylphenol Free Polymeric Thiophosphate A | 107.0 |
| Alkylphenol Free Polymeric Thiophosphate B | 102.3 |
| Polymeric Ester-5% | 111.9 |
| Polymeric Ester-10% | 113.1 |
| Polymeric Ester-25% | 129.5 |

Microtap Tap and Torque Testing: Microtap testing is one method used to determine a fluids ability to remove metal. A metal bar with predrilled holes is fastened to a vice. The tap and the metal bar are coated in the fluid to be tested. The tap rotates to tap out the pre-drilled hole. The force needed to tap the hole is measured by a computer and is reported as torque in newton centimeters. In all cases, higher percent efficiency refers to the performance of the fluid being better.

In this test, all formulae were evaluated on 1018 Steel.

1018 Steel

| Additive | % Efficiency |
|---|---|
| Paroil 152, Std. | 100.0 |
| Doverphos 53 | 101.7 |
| ZDDP | 101.1 |
| Base 10SE | 100.5 |
| Doverphos 253 | 101.1 |
| Mayfree 133 | 103.8 |
| Alkylphenol Free Polymeric Phosphite A | 103.1 |
| Alkylphenol Free Polymeric Phosphite B | 102.9 |
| Doverphos 50 | 103.8 |
| Alkylphenol Free Polymeric Thiophosphate A | 103.5 |
| Alkylphenol Free Polymeric Thiophosphate B | 104.3 |
| Polymeric Ester-5% | 105.2 |
| Polymeric Ester-10% | 104.0 |
| Polymeric Ester-25% | 106.9 |

Figure 2:
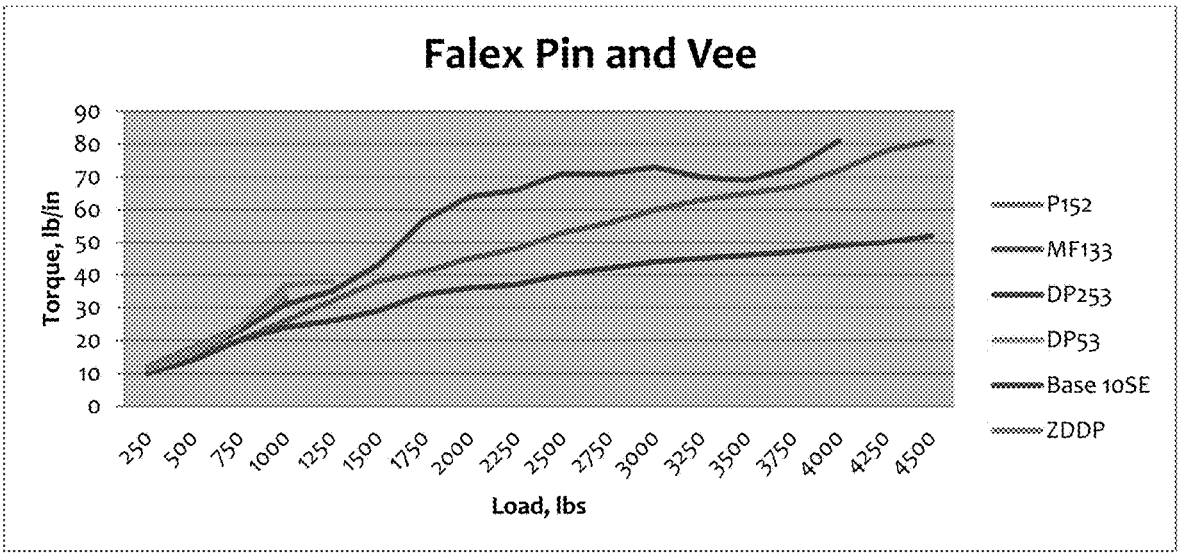
FIG. 2 is a graph showing Falex Pin and Vee Block test results.
Figure 3:
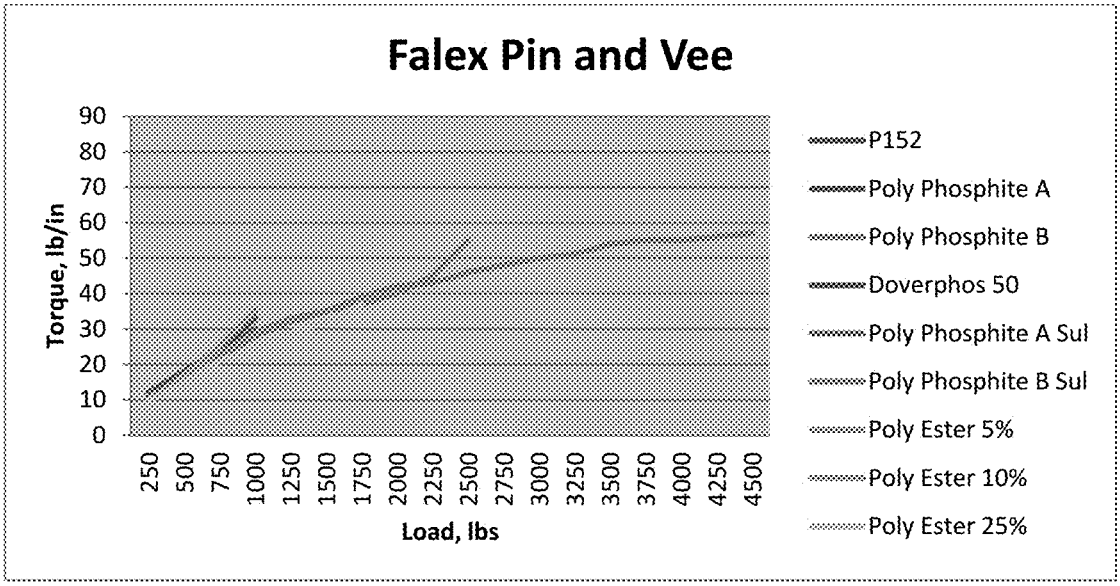
FIG. 3 is a graph showing Falex Pin and Vee Block test results.

Falex Pin and Vee Block Testing: Falex Pin and Vee Block measures the fluids ability to perform in more severe operations, such as cold heading, but can also apply to grinding operations. A pin is fastened using a brass shear pin. Two Vee blocks are clamped onto the pin. The pin and vee blocks are submerged in the fluid to be tested. The load applied on the pin from the vee blocks begins at 250 pounds. The load is increased automatically by a ratcheting arm as the pin spins between the two vee blocks. The torque generated by the load on the pin is read at 250 pound load and is recorded every 250 pounds until a final load of 4500 pounds is reached or a failure occurs. A failure implies the pin or shear pin has broken. See FIGS. 2 and 3.

Water Based Testing:

Microtap Tap and Torque Testing: Microtap testing is one method used to determine a fluids ability to remove metal. A metal bar with predrilled holes is fastened to a vice. The tap and the metal bar are coated in the fluid to be tested. The tap rotates to tap out the predrilled hole. The force needed to tap the hole is measured by a computer and is reported as torque in newton centimeters. In all cases, higher percent efficiency refers to the performance of the fluid being better.

In this test, all formulae were evaluated on 1018 Steel and 316 Stainless Steel.

316 Stainless Steel

| Additive | % Efficiency |
|---|---|
| Paroil 152, Std. | 100.0 |
| Doverphos 53 | 108.6 |

-continued

| Additive | % Efficiency |
|---|---|
| Doverphos 253 | 112.0 |
| Mayfree 133 | 117.6 |
| Alkylphenol Free Polymeric Phosphite A | 109.4 |
| Alkylphenol Free Polymeric Phosphite B | 112.1 |
| Doverphos 50 | 109.4 |
| Polymeric Ester-5% | 107.6 |

1018 Steel

| Additive | % Efficiency |
|---|---|
| Paroil 152, Std. | 100.0 |
| Doverphos 53 | 102.4 |
| Doverphos 253 | 101.1 |
| Mayfree 133 | 101.9 |
| Alkylphenol Free Polymeric Phosphite A | 100.9 |
| Alkylphenol Free Polymeric Phosphite B | 100.2 |
| Doverphos 50 | 100.0 |
| Polymeric Ester-5% | 99.3 |

Figure 4:
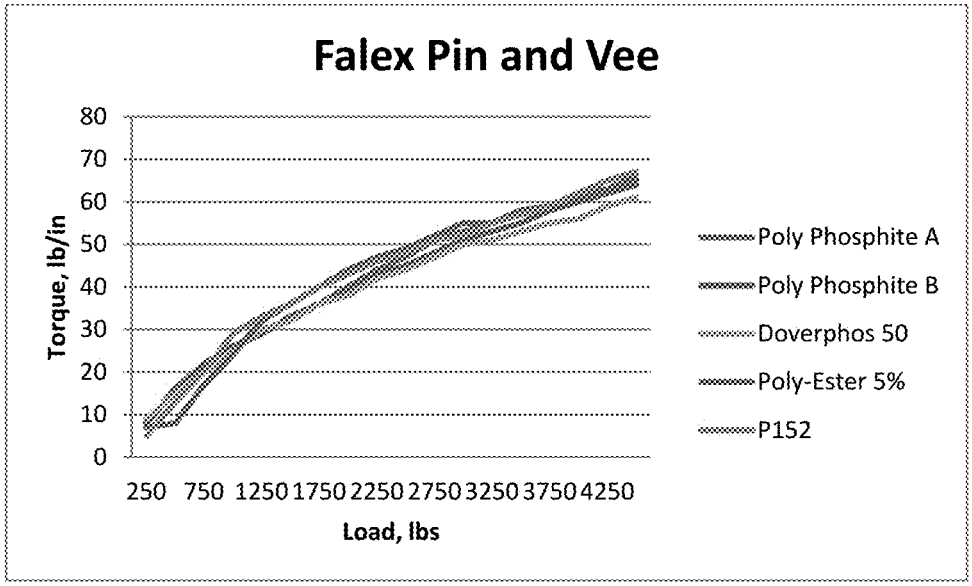
FIG. 4 is a graph showing Falex Pin and Vee Block test results.
Figure 5:
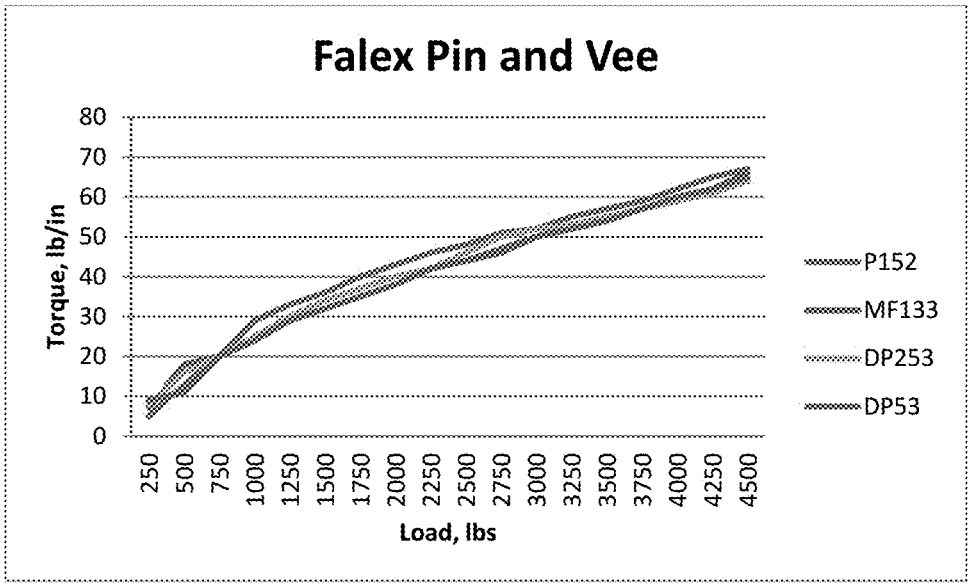
FIG. 5 is a graph showing Falex Pin and Vee Block test results.

Falex Pin and Vee Block Testing: Falex Pin and Vee Block measures the fluids ability to perform in more severe operations, such as cold heading, but can also apply to grinding operations. A pin is fastened using a brass shear pin. Two Vee blocks are clamped onto the pin. The pin and vee blocks are submerged in the fluid to be tested. The load applied on the pin from the vee blocks begins at 250 pounds. The load is increased automatically by a ratcheting arm as the pin spins between the two vee blocks. The torque generated by the load on the pin is read at 250 pound load and is recorded every 250 pounds until a final load of 4500 pounds is reached or a failure occurs. A failure implies the pin or shear pin has broken. See FIGS. 4 and 5.

What is claimed is:

1. A composition comprising a compound having the structure:

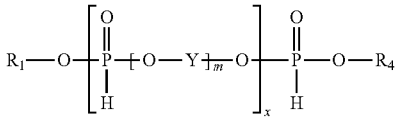

wherein each R is an independently selected alkylphenol-free moiety that is a $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety;

wherein each Y is an independently selected alkylphenol-free moiety that is a $C_{2-40}$ alkylene moiety, $C_{7-40}$ cycloalkylene moiety, or $C_{3-40}$ alkyl lactone moiety;

wherein m is an integer that is 2 or more; and wherein x is an integer ranging from 1 to 1000.

2. The composition of claim 1, wherein each Y is an ethylene moiety, propylene moiety, or caprylactone moiety.

3. The composition of claim 1, wherein the compound has a weight ranging from 1000 to 30000 Daltons.

4. The composition of claim 1, wherein the compound has a weight ranging from 400 to 30000 Daltons.

5. The composition of claim 1, wherein the compound has a weight ranging from 500 to 30000 Daltons.

6. A method comprising the step of using the compound of claim 1 as a metalworking fluid additive by adding the compound to a metalworking fluid.

7. A composition comprising a compound having the structure:

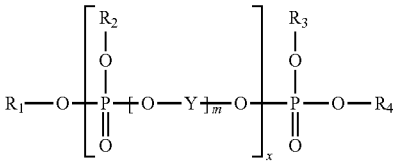

wherein each R is an independently selected alkylphenol-free moiety that is a $C_{1-20}$ alkyl, $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety;

wherein each Y is an independently selected alkylphenol-free moiety that is a $C_{2-40}$ alkylene moiety, $C_{7-40}$ cycloalkylene moiety, or $C_{3-40}$ alkyl lactone moiety;

wherein m is an integer that is 2 or more; and wherein x is an integer ranging from 1 to 1000.

8. The composition of claim 7, wherein each Y is an ethylene moiety, propylene moiety, or caprylactone moiety.

9. The composition of claim 7, wherein the compound has a weight ranging from 1000 to 30000 Daltons.

10. The composition of claim 7, wherein the compound has a weight ranging from 400 to 30000 Daltons.

11. The composition of claim 7, wherein the compound has a weight ranging from 500 to 30000 Daltons.

12. A method comprising the step of using the compound of claim 7 as a metalworking fluid additive by adding the compound to a metalworking fluid.

13. A composition comprising a compound having the structure:

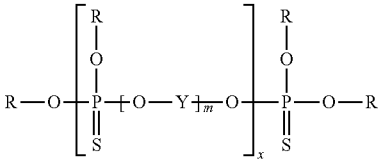

wherein each R is an independently selected alkylphenol-free moiety that is a $C_{1-20}$ alkyl, $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety;

wherein each Y is an independently selected alkylphenol-free moiety that is a $C_{2-40}$ alkylene moiety, $C_{7-40}$ cycloalkylene moiety, or $C_{3-40}$ alkyl lactone moiety;

wherein m is an integer that is 2 or more; and wherein x is an integer ranging from 1 to 1000.

14. The composition of claim 13, wherein each Y is an ethylene moiety, propylene moiety, or caprylactone moiety.

15. The composition of claim 13, wherein the compound has a weight ranging from 1000 to 30000 Daltons.

16. The composition of claim 13, wherein the compound has a weight ranging from 400 to 30000 Daltons.

17. The composition of claim 13, wherein the compound has a weight ranging from 500 to 30000 Daltons.

18. A method comprising the step of using the compound of claim 13 as a metalworking fluid additive by adding the compound to a metalworking fluid.

19. A composition comprising a compound having the structure:

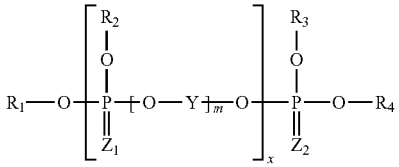

wherein each R is an independently selected alkylphenol-free moiety that is a $C_{1-20}$ alkyl, $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety;

wherein each Y is an independently selected alkylphenol-free moiety that is a $C_{2-40}$ alkylene moiety, $C_{7-40}$ cycloalkylene moiety, or $C_{3-40}$ alkyl lactone moiety;

wherein each Z is independently selected from the group consisting of S and O;

wherein m is an integer that is 2 or more; and wherein x is an integer ranging from 1 to 1000.

20. The composition of claim 19, wherein each Y is an ethylene moiety, propylene moiety, or caprylactone moiety.

21. The composition of claim 19, wherein the compound has a weight ranging from 1000 to 30000 Daltons.

22. The composition of claim 19, wherein the compound has a weight ranging from 400 to 30000 Daltons.

23. The composition of claim 19, wherein the compound has a weight ranging from 500 to 30000 Daltons.

24. A method comprising the step of using the compound of claim 19 as a metalworking fluid additive by adding the compound to a metalworking fluid.

25. A composition comprising a compound having the structure:

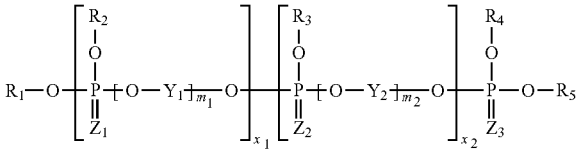

wherein each R is an independently selected alkylphenol-free moiety that is a $C_{1-20}$ alkyl, $C_{2-22}$ alkenyl, $C_{6-40}$ cycloalkyl, $C_{7-40}$ cycloalkylene, $C_{3-20}$ methoxy alkyl glycol ether, $C_{3-20}$ alkyl glycol ether, or Y—OH moiety;

wherein each Y is an independently selected alkylphenol-free moiety that is a $C_{2-40}$ alkylene moiety, $C_{7-40}$ cycloalkylene moiety, or $C_{3-40}$ alkyl lactone moiety;

wherein each Z is independently selected from the group consisting of S and O;

wherein each m is an integer ranging from 1 to 100;

wherein $m_1+m_2=3$ or more; and wherein each x is an integer ranging from 1 to 1000.

26. The composition of claim 25, wherein each Y is an ethylene moiety, propylene moiety, or caprylactone moiety.

27. The composition of claim 25, wherein the compound has a weight ranging from 1000 to 30000 Daltons.

28. The composition of claim 25, wherein the compound has a weight ranging from 400 to 30000 Daltons.

29. The composition of claim 25, wherein the compound has a weight ranging from 500 to 30000 Daltons.

30. A method comprising the step of using the compound of claim 25 as a metalworking fluid additive by adding the compound to a metalworking fluid.

* * * * *